US011410604B2

(12) United States Patent
Feng et al.

(10) Patent No.: US 11,410,604 B2
(45) Date of Patent: Aug. 9, 2022

(54) PIXEL CIRCUIT AND A METHOD OF DRIVING THE SAME AND A DISPLAY PANEL

(71) Applicants: Chengdu BOE Optoelectronics Technology Co., Ltd., Chengdu (CN); BOE Technology Group Co., Ltd., Beijing (CN)

(72) Inventors: Yuhsiung Feng, Beijing (CN); Wenbo Chen, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/259,983

(22) PCT Filed: Mar. 31, 2020

(86) PCT No.: PCT/CN2020/082575
§ 371 (c)(1),
(2) Date: Jan. 13, 2021

(87) PCT Pub. No.: WO2021/196020
PCT Pub. Date: Oct. 7, 2021

(65) Prior Publication Data
US 2022/0051621 A1 Feb. 17, 2022

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
None
See application file for complete search history.

(56) References Cited

U.S. PATENT DOCUMENTS 10,115,342 B2 10/2018 Li
10,692,440 B2 6/2020 Kuk et al.
(Continued)

FOREIGN PATENT DOCUMENTS

CN 106601191 A 4/2017
CN 110021273 A 7/2019
(Continued)

*Primary Examiner* — Dorothy Harris
(74) *Attorney, Agent, or Firm* — Westman, Champlin & Koehler, P.A.

(57) ABSTRACT

The embodiments of the present disclosure provide a pixel driving circuit of driving a light emitting element to emit light. The pixel driving circuit comprises: a driving sub-circuit, configured to generate a current for making the light emitting element emit light; a light emitting control sub-circuit, electrically coupled to the driving sub-circuit and a first terminal of the light emitting element; a driving control sub-circuit, electrically coupled to the driving sub-circuit, wherein the driving control sub-circuit is configured to provide the data signal to the driving sub-circuit; a resetting sub-circuit, configured to reset the first node and the first terminal of the light emitting element; and a compensation sub-circuit, electrically coupled to the first node, wherein the compensation sub-circuit is configured to receive a compensation control signal, and compensate a voltage of the first node under a control of the compensation control signal.

15 Claims, 7 Drawing Sheets

(52) U.S. Cl.
CPC . *G09G 2300/0861* (2013.01); *G09G 2310/08* (2013.01); *G09G 2320/0247* (2013.01); *G09G 2320/045* (2013.01)

(56) References Cited

U.S. PATENT DOCUMENTS

| | | | | |
|---|---|---|---|---|
| 10,964,264 | B1 * | 3/2021 | Kim | G09G 3/325 |
| 2012/0064643 | A1 * | 3/2012 | Bawolek | G09G 3/006 438/16 |
| 2015/0103037 | A1 * | 4/2015 | Wu | G06F 3/0412 345/80 |
| 2017/0373094 | A1 * | 12/2017 | Park | H01L 27/1288 |
| 2018/0130424 | A1 * | 5/2018 | Gao | G09G 3/3291 |
| 2018/0211592 | A1 * | 7/2018 | Li | G09G 3/3233 |
| 2019/0392765 | A1 * | 12/2019 | Kuk | H01L 27/1225 |
| 2021/0056901 | A1 | 2/2021 | Ueno | |

FOREIGN PATENT DOCUMENTS

| | | | |
|---|---|---|---|
| CN | 110277060 | A | 9/2019 |
| CN | 110634446 | A | 12/2019 |
| CN | 110660360 | A | 1/2020 |
| EP | 3739567 | A1 | 11/2020 |
| WO | 2019186764 | A1 | 10/2019 |

* cited by examiner

PIXEL CIRCUIT AND A METHOD OF DRIVING THE SAME AND A DISPLAY PANEL

CROSS-REFERENCE TO RELATED APPLICATION(S)

This application is 371 National Stage Application of International Application No. PCT/CN2020/082575, filed on Mar. 31, 2020, which has not yet published, the content of which is incorporated herein by reference in its entirety.

TECHNICAL FIELD

The present disclosure relates to the field of display technology, and more particularly, to a pixel circuit and a method of driving the same and a display panel.

BACKGROUND

Organic Light Emitting Diodes (OLED) have the advantages of fast response speed and easy realization of high-resolution displays, and have gradually developed into a mainstream display technology, which is widely used in various fields. The pixel driving circuit of the OLED display device generally adopts LTPS (Low Temperature Poly Silicon) technology, which makes the pixel driving circuit poor in voltage holding at some key nodes, which causes the displayed picture to flicker and affects the display effect of the OLED display device.

SUMMARY

The embodiments of the present disclosure provides a pixel circuit and a method of driving the same and a display panel.

According to an aspect of the embodiments of the present disclosure, there is proposed a pixel driving circuit of driving a light emitting element to emit light, comprising: a driving sub-circuit, configured to generate a current for making the light emitting element emit light; a light emitting control sub-circuit, electrically coupled to the driving sub-circuit and a first terminal of the light emitting element, wherein the light emitting control sub-circuit is configured to receive a light emitting control signal, and provide the current for making the light emitting element emit light to the first terminal of the light emitting element under a control of the light emitting control signal; a driving control sub-circuit, electrically coupled to the driving sub-circuit, wherein the light emitting control sub-circuit is configured to receive a data signal and a gate driving signal, and provide the data signal to the driving sub-circuit under a control of the gate driving signal; a resetting sub-circuit, electrically coupled to the driving sub-circuit and the first terminal of the light emitting element, and electrically coupled to the driving sub-circuit at a first node, wherein the resetting sub-circuit is configured to receive a first resetting signal and a second resetting signal, and reset the first node and the first terminal of the light emitting element under a control of the first resetting signal and the second resetting signal; and a compensation sub-circuit, electrically coupled to the first node, wherein the compensation sub-circuit is configured to receive a compensation control signal, and compensate a voltage of the first node under a control of the compensation control signal.

In some embodiments, the compensation sub-circuit comprises a first transistor, a gate of the first transistor is electrically coupled to receive the compensation control signal, a first electrode of the first transistor is electrically coupled to receive a first voltage signal, and a second electrode of the first transistor is electrically coupled to the first node.

In some embodiments, the first transistor is a P-type transistor.

In some embodiments, the compensation control signal has a first level, and the first transistor is in an off state under the control of the compensation control signal.

In some embodiments, a channel width-to-length ratio of the first transistor is greater than or equal to 10/3.5.

In some embodiments, the driving sub-circuit comprises a driving transistor, a second transistor, and a storage capacitor, wherein a gate of the driving transistor is electrically coupled to the first node, a first electrode of the driving transistor and the light emitting control sub-circuit are electrically coupled at a second node, and a second electrode of the driving transistor and the light emitting control sub-circuit are electrically coupled at a third node; a gate of the second transistor is electrically coupled to receive the gate driving signal, a first electrode of the second transistor is electrically coupled to the first node, and a second electrode of the second transistor is electrically coupled to the third node; and a first terminal of the storage capacitor is electrically coupled to receive the first voltage signal, and a second terminal is electrically coupled to the first node.

In some embodiments, the driving transistor is a P-type transistor.

In some embodiments, a channel width-to-length ratio of the second transistor is less than or equal to 2/3.5.

In some embodiments, the driving control sub-circuit comprises a third transistor, a gate of the third transistor is electrically coupled to receive the gate driving signal, a first electrode of the third transistor is electrically coupled to receive the data signal, and a second electrode of the third transistor and the light emitting control sub-circuit are electrically coupled at the second node.

In some embodiments, the light emitting control sub-circuit comprises a fourth transistor and a fifth transistor, wherein a first electrode of the fourth transistor is electrically coupled to receive a first voltage signal, and a second electrode of the fourth transistor and a light emitting control sub-circuit are electrically coupled at the second node; a gate of the fifth transistor is electrically coupled to receive the light emitting control signal, a first electrode of the fifth transistor and the light emitting control sub-circuit are electrically coupled at a third node, and a second electrode of the fifth transistor is electrically coupled to the first terminal of the light emitting element.

In some embodiments, the resetting sub-circuit comprises a sixth transistor and a seventh transistor, wherein a gate of the sixth transistor is electrically coupled to receive the first resetting signal, a first electrode of the sixth transistor is electrically coupled to the first node, and a second electrode of the sixth transistor is electrically coupled to receive a resetting reference signal; a gate of the seventh transistor is electrically coupled to receive the second resetting signal, a first electrode of the seventh transistor is electrically coupled to receive the resetting reference signal, and a second electrode of the seventh transistor is electrically coupled to the first terminal of the light emitting element.

In some embodiments, the resetting sub-circuit comprises a sixth transistor and a seventh transistor, wherein a gate of the sixth transistor is electrically coupled to receive the first resetting signal, a first electrode of the sixth transistor is electrically coupled to the first node, and a second electrode of the sixth transistor is electrically coupled to receive a resetting reference signal; a gate of the seventh transistor is electrically coupled to receive the second resetting signal, a first electrode of the seventh transistor is electrically coupled to receive the resetting reference signal, and a second electrode of the seventh transistor is electrically coupled to the first terminal of the light emitting element; wherein the second resetting signal is used as the compensation control signal.

In some embodiments, a channel width-to-length ratio of the sixth transistor is less than or equal to 2/3.5.

According to another aspect of the embodiments of the present disclosure, there is also proposed a display panel, comprising: a plurality of scan lines; a plurality of data lines, arranged to cross the plurality of scan lines; and a plurality of pixel units, arranged in a form of a matrix at an intersection of each data line and each scan line, wherein the plurality of pixel units are electrically coupled to a data line of the plurality of data lines and a scan line of the plurality of scan lines, wherein each pixel unit comprises a light emitting element and the pixel driving circuit of any one of claims 1-12, wherein a data signal received by the pixel driving circuit is provided via the data line for the pixel unit, and a gate driving signal received by the pixel driving circuit is provided via the scan line for the pixel unit.

According to another aspect of the embodiments of the present disclosure, there is also proposed a method for driving the pixel driving circuit, comprising: providing a light emitting control signal and a gate driving signal with a first level, and providing a first resetting signal and a second resetting signal with a second level, during a first period; providing a light emitting control signal, a first resetting signal, and a second resetting signal with a first level, and providing a gate driving signal with a second level, during a second period; and providing a first resetting signal, a second resetting signal, and a gate driving signal with a first level, and providing a light emitting control signal with a second level, during a third period.

In some embodiments, providing a compensation control signal with the first level, during the first period, the second period and the third period.

In some embodiments, in response to the second resetting signal being used as the compensation control signal, providing a second resetting signal with a first level during the first period, the second period and the third period.

BRIEF DESCRIPTION OF THE ACCOMPANYING DRAWINGS

In order to explain the technical solutions of the embodiments of the present disclosure more clearly, the following may briefly introduce the drawings that need to be used in the description of the embodiments of the present disclosure. Obviously, the drawings in the following description are only some embodiments of the present disclosure. For those of ordinary skill in the art, other drawings can be obtained without creative work based on these drawings, in which:

FIG. 1 shows a block schematic of a pixel driving circuit according to an embodiment of the present disclosure;

FIGS. 2*a* and 2*b* show circuit diagrams of a pixel driving circuit according to an embodiment of the present disclosure;

Figure 5A:
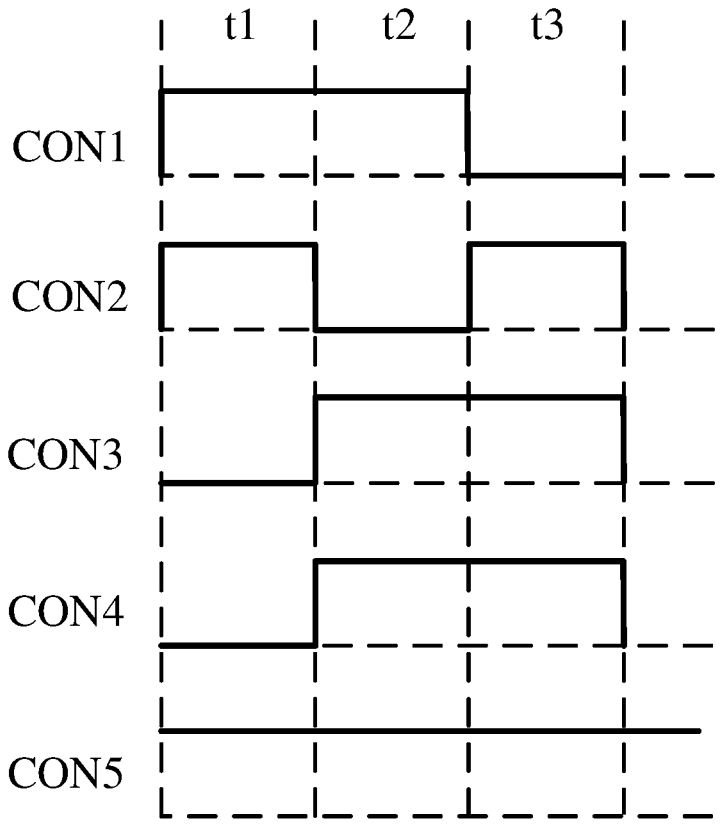
Figure 5B:
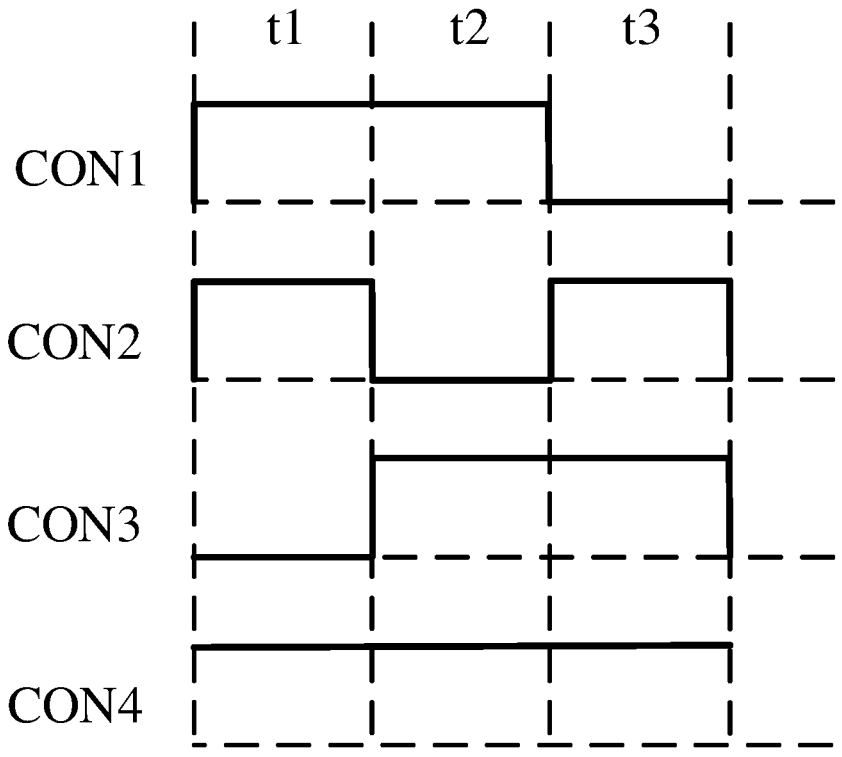
Figure 6:
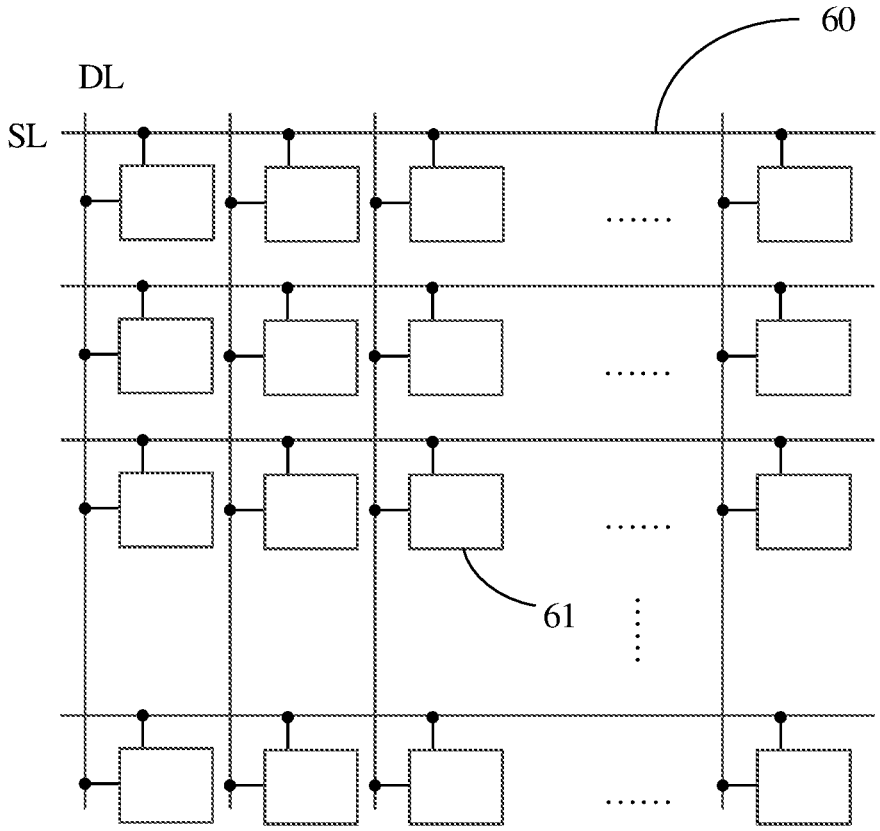

FIGS. 5*a* and 5*b* show signal timing diagrams of a driving method of a pixel driving circuit according to an embodiment of the present disclosure; and FIG. 6 shows a block schematic of a display panel according to an embodiment of the present disclosure.

DETAILED DESCRIPTION

In order to make the objectives, technical solutions, and advantages of the embodiments of the present disclosure clearer, the technical solutions in the embodiments of the present disclosure may be described clearly and completely in conjunction with the accompanying drawings in the embodiments of the present disclosure. Obviously, the described embodiments are part of the embodiments of the present disclosure, but not all of them. Based on the described embodiments of the present disclosure, all other embodiments obtained by those of ordinary skill in the art without creative labor are within the protection scope of the present disclosure. It should be noted that throughout the drawings, the same elements are represented by the same or similar reference signs. In the following description, some specific embodiments are only used for descriptive purposes, and should not be construed as limiting the present disclosure, but are merely examples of the embodiments of the present disclosure. When it may cause confusion in the understanding of the present disclosure, conventional structures or configurations may be omitted. It should be noted that the shape and size of each component in the drawings do not reflect the actual size and ratio, but merely illustrate the content of the embodiment of the present disclosure.

Unless otherwise defined, the technical terms or scientific terms used in the embodiments of the present disclosure should have the usual meanings understood by those skilled in the art. The "first", "second" and similar words used in the embodiments of the present disclosure do not denote any order, quantity or importance, but are only used to distinguish different components.

In addition, in the description of the embodiments of the present disclosure, the term "electrically coupled" may mean that two components are directly electrically coupled, or may mean that two components are electrically coupled via one or more other components. In addition, these two components can be electrically coupled or coupled in a wired or wireless manner.

The transistors used in the embodiments of the present disclosure may all be thin film transistors or field effect transistors or other devices with the same characteristics. According to the role in the circuit, the transistors used in the embodiments of the present disclosure are mainly switching transistors. Since the source and drain of the thin film transistor used here are symmetrical, the source and drain can be interchanged. In the embodiments of the present disclosure, one of the source electrode and the drain electrode is called the first electrode, and the other of the source electrode and the drain electrode is called the second electrode.

In addition, in the description of the embodiments of the present disclosure, the terms "first level" and "second level" are only used to distinguish the two levels from being different in amplitude. In some embodiments, the "first level" may be a high level, and the "second level" may be a low level. Hereinafter, since the driving transistor is exemplified as a P-type thin film transistor, the "first level" is exemplified as a high level, and the "second level" is exemplified as a low level.

OLED display technology is widely used in portable or handheld devices, so reducing the power consumption of OLED displays is very important. In order to reduce the power consumption of the OLED display screen, when the OLED display screen is used to display a static picture, the display frame rate can be appropriately lowered, that is, for the static picture, the down-frame-rate display can be performed. Down-frame-rate display means that the time interval between each refresh of the OLED driving circuit needs to be extended, which is very disadvantageous for nodes that require high voltage holding abilities, especially for the gate voltage of the driving transistor closely related to the generation of current flowing through the OLED.

The embodiments of the present disclosure may be described in details below with reference to the drawings.

Figure 1:
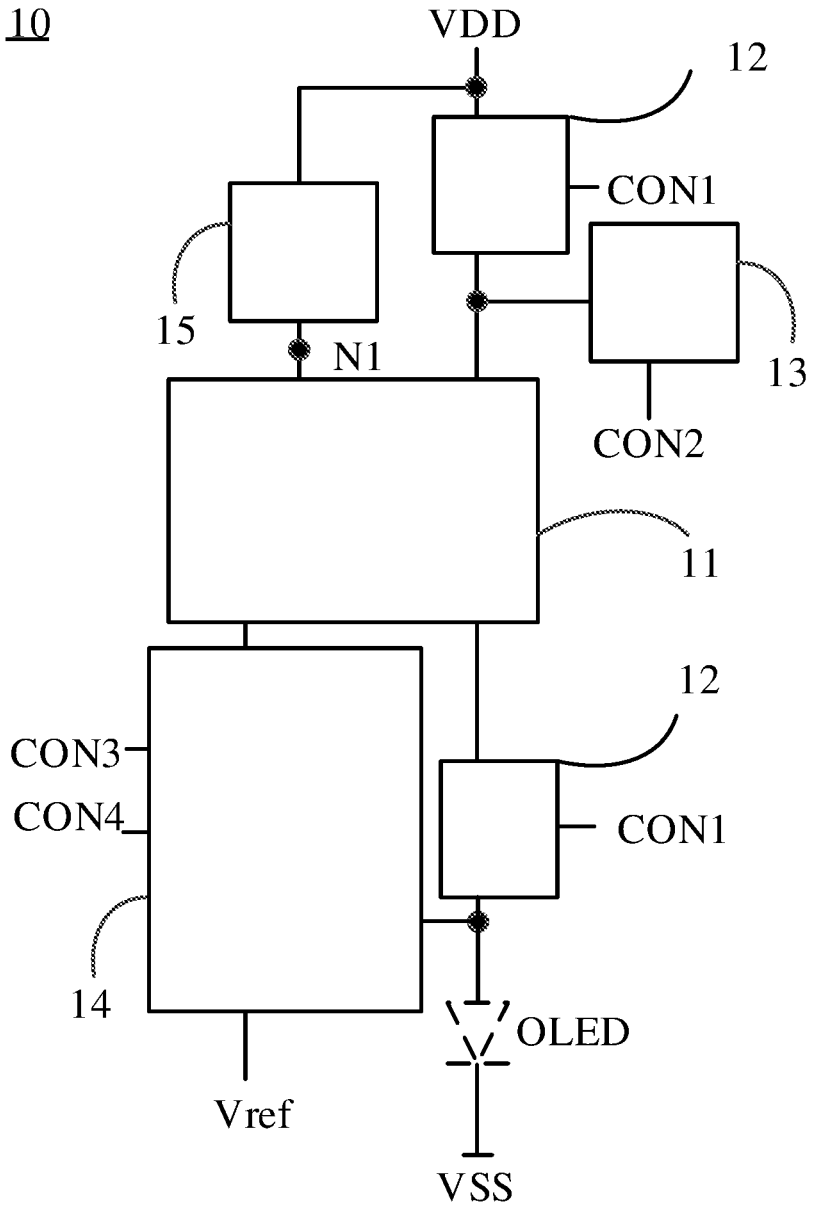

FIG. 1 shows a block schematic of a pixel driving circuit 10 according to an embodiment of the present disclosure. The pixel driving circuit 10 is configured to drive a light emitting element to emit light. In FIG. 1, the light emitting element is illustrated in the form of an OLED, but this is only an example, the light emitting element may also be other current-driven devices, and the embodiments of the present disclosure are not limited thereto. In order to show the coupling relationship between the pixel driving circuit 10 and the light emitting element OLED more clearly, the light emitting element OLED is shown in the form of a dashed line. As shown in FIG. 1, a first terminal of the light emitting element OLED is electrically coupled to the pixel driving circuit 10, and a second terminal of the light emitting element OLED is electrically coupled to a fixed voltage VSS. The first terminal may be the anode of the light emitting element OLED, and the second terminal may be the cathode of the light emitting element OLED.

As shown in FIG. 1, the pixel driving circuit 10 comprises a driving sub-circuit 11 configured to generate a current for making the light emitting element OLED emit light.

As shown in FIG. 1, the pixel driving circuit 10 further comprises a light emitting control sub-circuit 12, the light emitting control sub-circuit 12 and the driving sub-circuit 11 are electrically coupled at a second node N2, and the light emitting control sub-circuit 12 and the first terminal of the light emitting element OLED are simultaneously electrically coupled at a third node. According to an embodiment, the light emitting control sub-circuit 12 is configured to receive a light emitting control signal CON1, and provide the current for making the light emitting element OLED emit light to the first terminal of the light emitting element OLED under a control of the light emitting control signal CON1.

As shown in FIG. 1, the pixel driving circuit 10 further comprises a driving control sub-circuit 13, the driving control sub-circuit 13 and the driving sub-circuit 11 are electrically coupled at the second node N2. According to an embodiment, the driving control sub-circuit 13 is configured to receive a data signal Vdata and a gate driving signal CON2, and provide the data signal Vdata to the driving sub-circuit 11 under a control of the gate driving signal CON2.

As shown in FIG. 1, the pixel driving circuit 10 further comprises a resetting sub-circuit 14, electrically coupled to the driving sub-circuit 11 and the first terminal of the light emitting element OLED. As shown in FIG. 1, the resetting sub-circuit 14 and the driving sub-circuit 11 are electrically coupled at a first node N1. According to an embodiment, the resetting sub-circuit 14 is configured to receive a first resetting signal CON3, a second resetting signal CON4, and a resetting reference signal Vref, and reset the first node N1 and the first terminal of the light emitting element OLED under a control of the first resetting signal CON3 and the second resetting signal CON4.

As shown in FIG. 1, the pixel driving circuit 10 further comprises a compensation sub-circuit 15, the compensation sub-circuit 15 and the driving sub-circuit 11 are electrically coupled to the first node N1. According to an embodiment, the compensation sub-circuit 15 is configured to compensate a voltage of the first node N1.

Figure 2A:
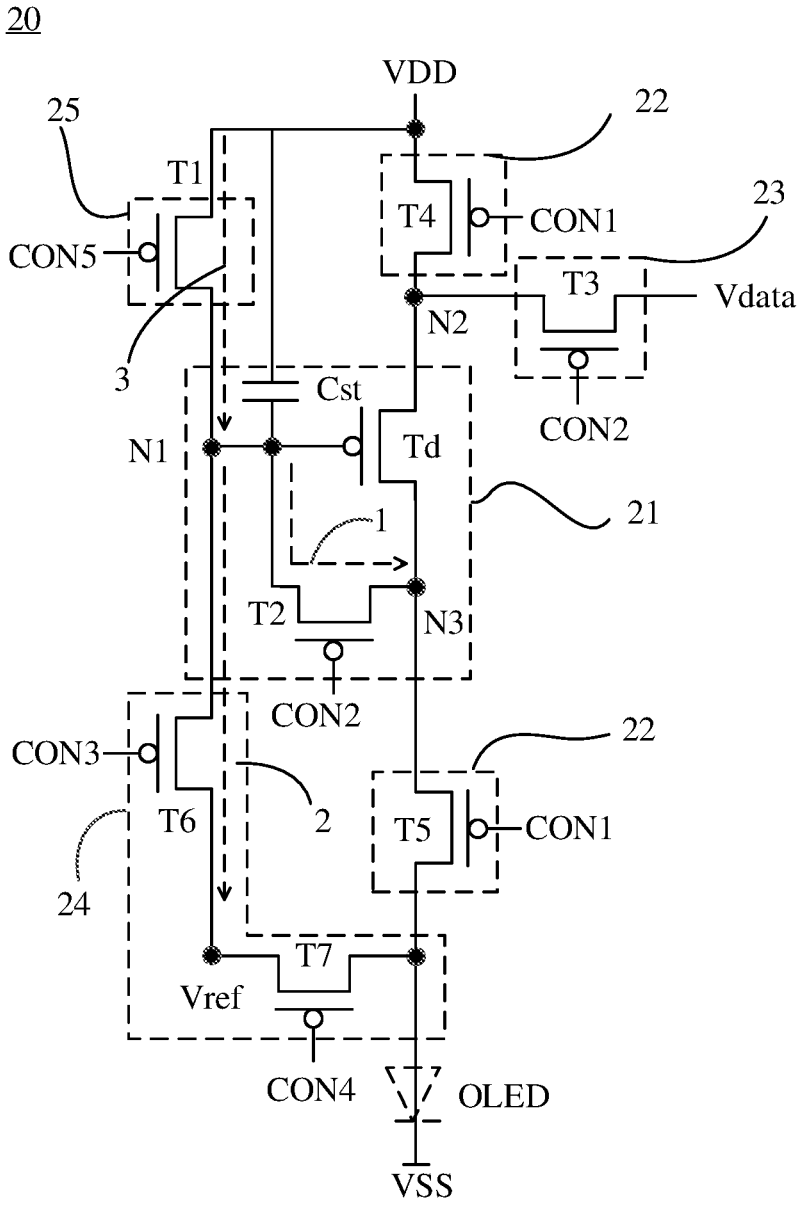
Figure 2B:
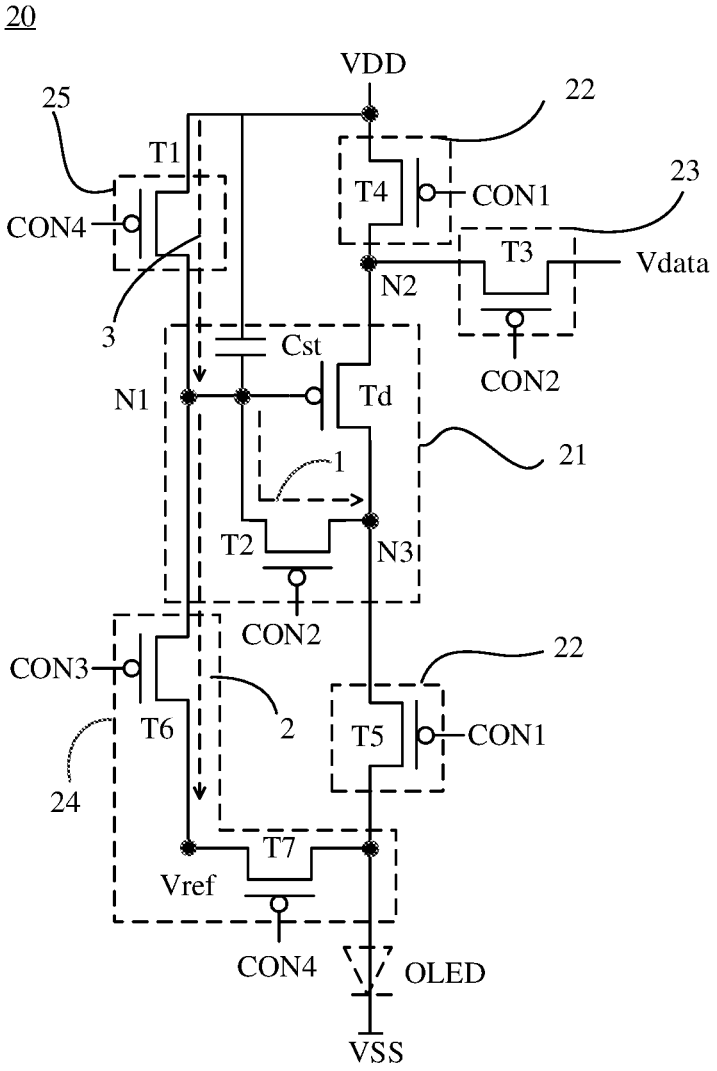

FIGS. 2*a* and 2*b* show circuit diagrams of a pixel driving circuit according to an embodiment of the present disclosure.

As shown in FIG. 2*a*, the driving sub-circuit 21 comprises a driving transistor Td, a second transistor T2 and a storage capacitor Cst. According to the embodiment, a gate of the driving transistor Td is electrically coupled to the first node N1, a first electrode of the driving transistor Td and the light emitting control sub-circuit 22 are electrically coupled at a second node N2, and a second electrode of the driving transistor Td and the light emitting control sub-circuit 22 are electrically coupled at the third node N3. A gate of the second transistor T2 is electrically coupled to receive the gate driving signal CON2, a first electrode of the second transistor T2 is electrically coupled to the first node N1, and a second electrode of the second transistor T2 is electrically coupled to the third node N3. A first terminal of the storage capacitor Cst is electrically coupled to receive the first voltage signal VDD, and a second terminal is electrically coupled to the first node N1.

As shown in FIG. 2*a*, the light emitting control sub-circuit 22 comprises a fourth transistor T4 and a fifth transistor T5. According to an embodiment, a gate of the fourth transistor T4 is electrically coupled to receive the light emitting control signal CON1, a first electrode of the fourth transistor T4 is electrically coupled to receive the first voltage signal VDD, and a second electrode of the fourth transistor T4 is electrically coupled to the second Node N2. A gate of the fifth transistor T5 is electrically coupled to receive the light emitting control signal CON1, a first electrode of the fifth transistor T5 is electrically coupled to the third node N3, and a second electrode of the fifth transistor T5 is electrically coupled to the first terminal of the light emitting element OLED.

In an exemplary embodiment, the fourth transistor T4 and the fifth transistor T5 may both be P-type transistors or both be N-type transistors.

As shown in FIG. 2*a*, the driving control sub-circuit 23 comprises a third transistor T3. According to an embodiment, a gate of the third transistor T3 is electrically coupled to receive the gate driving signal CON1, a first electrode of the third transistor T3 is electrically coupled to receive the data signal Vdata, and a second electrode of the third transistor T3 is electrically coupled to the second node N2.

As shown in FIG. 2*a*, the resetting sub-circuit 24 comprises a sixth transistor T6 and a seventh transistor T7. According to an embodiment, a gate of the sixth transistor T6 is electrically coupled to receive the first resetting signal CON3, a first electrode of the sixth transistor T6 is electrically coupled to the first node N1, and a second electrode of the sixth transistor T6 is electrically coupled to receive a resetting reference signal Vref. The gate of the seventh transistor T7 is electrically coupled to receive the second resetting signal CON4, the first electrode of the seventh transistor T7 is electrically coupled to receive the resetting reference signal Vref, and a second electrode of the seventh transistor T7 is electrically coupled to the first terminal of the light emitting element OLED.

In an exemplary embodiment, the sixth transistor T6 and the seventh transistor T7 may both be P-type transistors or both be N-type transistors.

As shown in FIG. 2*a*, the driving transistor Td is a P-type transistor, and the gate of the driving transistor Td (i.e., the first node N1) is electrically coupled to the first electrode of the second transistor T2 and the first electrode of the sixth transistor T6. In the holding phase of the pixel unit including the pixel driving circuit, the second transistor T2 and the sixth transistor T6 are both in an off state. As the transistor made by the LTPS process has a large leakage current, there may be current flowing out of the first node N1, as indicated by dashed lines 1 and 2 with arrows in FIG. 2*a*. The dashed line 1 with arrow indicates that a leakage current $I_{off2}$ of the second transistor T2 flows from the first node N1 (the first electrode of the second transistor T2) to the second electrode of the second transistor T2 via the second transistor T2. The dashed line 2 with arrow indicates that a leakage current $I_{off6}$ of the sixth transistor T6 flows from the first node N1 (the first electrode of the sixth transistor T6) to the second electrode of the sixth transistor T6 via the sixth transistor T6. This may cause a change in the gate voltage of the driving transistor Td, thereby affecting the current flowing through the light emitting element OLED, and degrading the image quality of the display.

According to an embodiment of the present disclosure, a compensation sub-circuit 25 is provided in the pixel driving circuit 20 to compensate the voltage of the first node N1, so as to hold the stability of the voltage of the first node N1.

As shown in FIG. 2*a*, the compensation sub-circuit 25 comprises a first transistor T1, a gate of the first transistor T1 is electrically coupled to receive a compensation control signal CON5, a first electrode of the first transistor T1 is electrically coupled to receive the first voltage signal VDD, and a second electrode of the first transistor T1 is electrically coupled to the first node N1. According to the embodiment, the compensation control signal CON5 with a first level may be provided, and the first transistor T1 may be in the off state under a control of the compensation control signal CON5 with the first level. In this way, a leakage current $I_{off1}$ of the first transistor T1 in the off state can flow from the first electrode to the second electrode of the first transistor T1, that is, the leakage current $I_{off1}$ flows from the first voltage VDD to the first node N1 via the first transistor T1, as shown by a dashed line 3 with arrow in FIG. 2*a*. The leakage current $I_{off1}$ flowing into the first node N1 can supplement the leakage current $I_{off2}$ and the leakage current $I_{off6}$ flowing out of the first node N1, so as to keep the voltage of the first node N1 stable.

In some other embodiments, the second resetting signal can be used as the compensation control signal, thereby saving signal lines and saving layout space. As shown in FIG. 2*b*, the compensation sub-circuit 25 comprises the first transistor T1. The gate of the first transistor T1 is electrically coupled to receive the compensation control signal (i.e., the second resetting signal CON4), the first electrode of the first transistor T1 is electrically coupled to receive the first voltage signal VDD, and the second electrode of the first transistor T1 is electrically coupled to the first node N1. According to the embodiment, the second resetting signal CON4 with the first level may be provided, and the first transistor T1 may be in the off state under a control of the second resetting signal CON4 with the first level. In this way, the leakage current $I_{off1}$ of the first transistor T1 in the off state can flow from the first electrode to the second electrode of the first transistor T1, that is, the leakage current $I_{off1}$ flows from the first voltage VDD to the first node N1 via the first transistor T1, as shown by the dashed line 3 with arrow in FIG. 2*b*. The leakage current $I_{off1}$ flowing into the first node N1 can supplement the leakage current $I_{off2}$ and the leakage current $I_{off6}$ flowing out of the first node N1, so as to keep the voltage of the first node N1 stable.

Since the first transistor T1 needs to be kept in the off state at all times, for a P-type first transistor T1, the second resetting signal CON4 is always at the first level, and the seventh transistor T7 is also kept in the off state. The seventh transistor T7 in the off state shunts the leakage current flowing through the OLED in the black screen display state, so as to better display the black screen.

According to the embodiment, the leakage currents $I_{off1}$, $I_{off2}$, and $I_{off6}$ can be adjusted by adjusting the channel width-to-length ratios of the first transistor T1, the second transistor T2, and the sixth transistor T6, so as to obtain the required voltage holding ability.

According to an embodiment, the voltage holding ability of the first node N1 decreases as the channel width-to-length ratio of the second transistor T2 and the sixth transistor T6 increases, and increases as the channel width-to-length ratio of the first transistor T1 increases. Therefore, appropriately increasing the channel width-to-length ratio of the first transistor T1, or appropriately reducing the channel width-to-length ratio of the second transistor T2, or appropriately reducing the channel width-to-length ratio of the sixth transistor T6 can increase the voltage holding ability of the first node N1. It is easy to understand that appropriately increasing the channel width-to-length ratio of the first transistor T1, and appropriately reducing the channel width-to-length ratio of the second transistor T2 and the sixth transistor T6, or meet the conditions of any two of the transistors at the same time can increase the voltage holding ability of the first node N1.

Those skilled in the art can understand that the leakage current of a transistor is related to the channel width-to-length ratio of the transistor and the voltage applied to the source and drain of the transistor when the transistor is in the off state. As shown in FIGS. 2*a* and 2*b*, as the channel width-to-length ratio of the second transistor T2 and the sixth transistor T6 is greater, and the voltage applied to the source and drain of the second transistor T2 and the sixth transistor T6 is greater, the leakage current from the first node N1 generated by the second transistor T2 and the sixth transistor T6 is greater. Conversely, as the channel width-to-length ratio of the second transistor T2 and the sixth transistor T6, and the voltage applied to the source and drain of the second transistor T2 and the sixth transistor T6 is smaller, the leakage current from the first node N1 generated by the second transistor T2 and the sixth transistor T6 is smaller. According to an embodiment, when the channel width-to-length ratios of the second transistor T2 and the sixth transistor T6 are both less than or equal to 2/3.5, a better voltage holding ability can be obtained at the first node N1. Similarly, as shown in FIGS. 2*a* and 2*b*, as the channel width-to-length ratio of the first transistor T1 is greater, and the voltage applied to the source and drain of the first transistor T1 is greater, the leakage current flowing into the first node N1 generated by the first transistor T1 is greater. Conversely, as the channel width-to-length ratio of the first transistor T1 is smaller, and the voltage applied to the source and drain of the first transistor T1 is smaller, the leakage current flowing into the first node N1 generated by the first transistor T1 is smaller. According to an embodiment, when the channel width-to-length ratio of the first transistor T1 is greater than or equal to 10/3.5, a better voltage holding ability can be obtained at the first node N1. For example, when the channel width-to-length ratio of the first transistor T1 is 10/3.5, and the channel width-to-length ratios of the second transistor T2 and the sixth transistor T6 are both 2/3.5, the voltage at the first node N1 is recorded at the frame rate of 30 Hz and 60 Hz respectively. At 30 Hz, the amount of change in the voltage at the first node N1 is 3.86% during the period from the current OLED reaching stable light emitting to the next re-driving of the current OLED to emit light. At 60 Hz, the amount of change in the voltage of the first node N1 is only 2.07%. In both cases, it is far less than the 8.6% change in voltage when the first transistor T1 is not increased.

In addition, in FIGS. 2*a* and 2*b*, the first transistor T1 is exemplified as a P-type transistor, because for the LTPS process, the P-type transistor has a larger leakage current than the N-type transistor, and the larger the leakage current of the first transistor T1, the more favorable it is to inject more current into the first node N1, that is, the greater the adjustment effect on the voltage holding ability of the first node N1. In FIGS. 2*a* and 2*b*, the second transistor T2 and the sixth transistor T6 are also shown as P-type transistors. In other embodiments, the second transistor T2 and the sixth transistor T6 may also be N-type transistors. The less current the second transistor T2 and the sixth transistor T6 draw from the first node N1, the less current the first transistor T1 needs to inject into the first node N1. Those skilled in the art can select the types of the first transistor T1, the second transistor T2, and the sixth transistor T6 according to the concept of the embodiments of the present disclosure and the desired adjustment effect.

When the first transistor T1 is a P-type transistor, as shown in FIG. 2*a*, the compensation control signal CON5 can be held at the high level, so that the first transistor T1 is always kept in the off state. Or as shown in FIG. 2*b*, the compensation control signal CON4 can be held at the high level, so that the first transistor T1 and the seventh transistor T7 are always kept in the off state.

According to the embodiments of the present disclosure, the ability to hold the gate voltage of the driving transistor can be improved, thereby stabilizing the current flowing through the light emitting element OLED, avoiding the flicker phenomenon of the screen during low-frame-rate display, and improving the display effect.

According to the embodiments of the present disclosure, a larger allowable range of process variation can be provided, thereby widening the process window. The widening of the process window helps to increase the yield of production and reduce the production cost.

Figure 3:
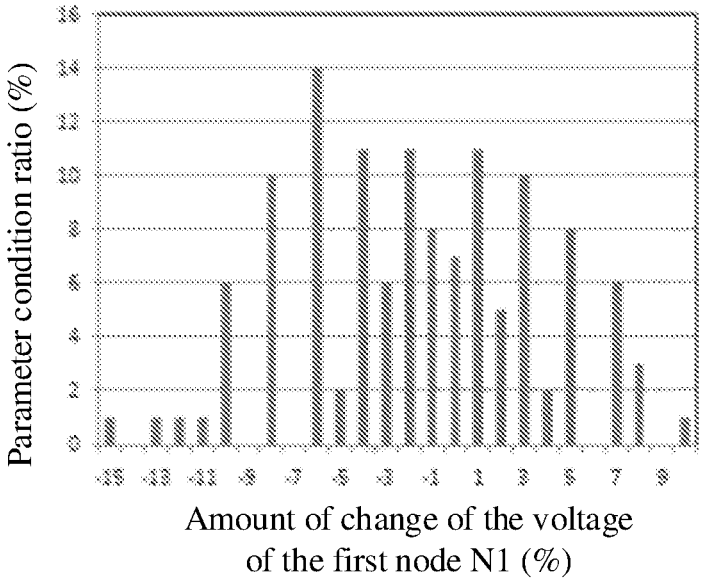
FIG. 3 shows a schematic diagram of the node voltage holding ability of the pixel driving circuit within the allowable range of process variation according to an embodiment of the present disclosure.

FIG. 3 shows a schematic diagram of the node voltage holding ability of the pixel driving circuit within the allowable range of process variation according to an embodiment of the present disclosure. Based on the following process parameters: the channel width-to-length ratio of the first transistor T1 is (10±1)/3.5, the channel width-to-length ratio of the second transistor T2 and the sixth transistor T6 is (2±1)/3.5, that is, the width-to-length ratios of the first transistor T1, the second transistor T2 and the sixth transistor T6 all have a variation of ±1, providing a relatively loose window for the process of the transistor. Those skilled in the art can understand that the channel width-to-length ratio of the second transistor T2 and the sixth transistor T6 can be the same or different, and it is only necessary that at least one of T2 and T6 is approximately located where the channel width-to-length ratio of the transistor is less than or equal to 2/3.5.

As shown in FIG. 3, the abscissa of the diagram shown in FIG. 3 is the amount of change of the voltage of the first node N1 (%), and the ordinate is the process parameter ratio (%). It can be seen from the diagram that the voltage variation range of the first node N1 is approximately −15.12% to 10.46% at 60 Hz, and approximately −27.5% to 18.02% at 30 Hz. Counting the voltage variation range of the first node N1 under the condition that the channel width-to-length ratio variation is ±1, the voltage value with the voltage variation of the first node N1 better than 2.07% accounts for nearly 50% of all the voltage value that the voltage of the first node N1 changes, and the voltage value with the voltage variation of the first node N1 better than 8.6% accounts for more than 90% of all the voltage value that the voltage of the first node N1 changes.

Figure 4:
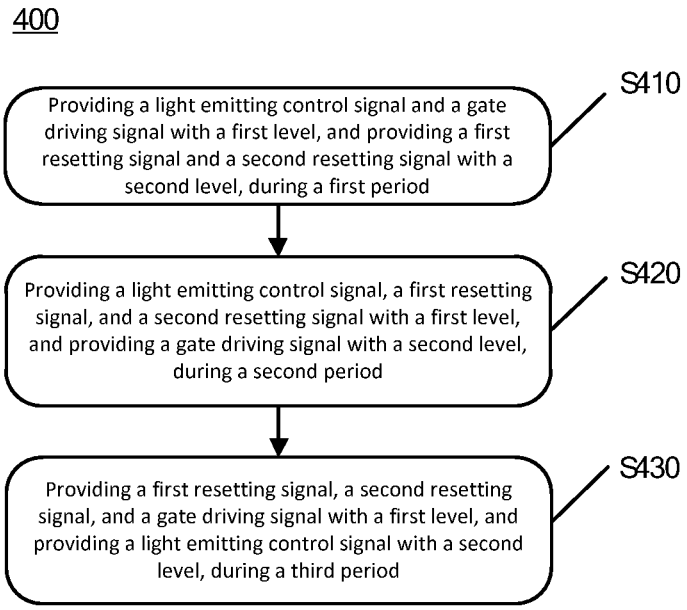
FIG. 4 shows a flowchart of a driving method of a pixel driving circuit according to an embodiment of the present disclosure.

FIG. 4 shows a flowchart of a driving method 400 of a pixel driving circuit according to an embodiment of the present disclosure, FIG. 5*a* shows a signal timing diagram of a driving method 400 of a pixel driving circuit according to an embodiment of the present disclosure, the driving method of the pixel driving circuit according to the embodiment of the present disclosure may be described below in conjunction with FIGS. 2*a* and 2*b*, FIG. 4 and FIGS. 5*a* and 5*b*.

As shown in FIG. 4, the driving method 400 of the pixel driving circuit comprises the following steps.

In step S410, providing a light emitting control signal and a gate driving signal with a first level, and providing a first resetting signal and a second resetting signal with a second level, during a first period.

In step S420, providing a light emitting control signal, a first resetting signal, and a second resetting signal with a first level, and providing a gate driving signal with a second level, during a second period.

In step S430, providing a first resetting signal, a second resetting signal, and a gate driving signal with a first level, and providing a light emitting control signal with a second level, during a third period.

As shown in FIG. 5*a*, during the first period t1, the light emitting control signal CON1 and the gate driving signal CON2 with a first level (i.e., a high level VH) are provided, and the first resetting signal CON3 and the second resetting signal CON4 with a second level (i.e., a low level VL) are provided.

Thus, during the first period t1, under the control of the light emitting control signal CON1, the fourth transistor T4 and the fifth transistor T5 are turned off. Under the control of the gate driving signal CON2, the second transistor T2 and the third transistor T3 are turned off. Under the control of the first resetting signal CON3, the sixth transistor T6 is turned on, and when the sixth transistor T6 is turned on, the resetting reference signal Vref is transmitted to the first node N1. Under the control of the second resetting signal CON4, the seventh transistor T7 is turned on, and when the seventh transistor T7 is turned on, the resetting reference signal Vref is transmitted to the first terminal of the light emitting element 150.

According to an embodiment, the resetting reference signal Vref may be the second level (i.e., the low level VL). Therefore, the resetting reference signal Vref may change the gate of the driving transistor Td to a low level, which may turn on the driving transistor Td. In addition, the anode of the light emitting element 150 also changes to a low level. As a result, both the driving transistor Td and the anode of the light emitting element 150 are reset by low level.

As shown in FIG. 5*a*, during the second period t2, the light emitting control signal CON1, the first resetting signal CON3, and the second resetting signal CON4 with the first level (i.e., the high level VH) are provided, and the gate driving signal CON2 with the second level (i.e., the low level VL) is provided.

Thus, during the second period t2, under the control of the light emitting control signal CON1, the fourth transistor T4 and the fifth transistor T5 are turned off. Under the control of the first resetting signal CON3 and the second resetting signal CON4, the sixth transistor T6 and the seventh transistor T7 are turned off. Under the control of the gate driving signal CON2, the second transistor T2 and the third transistor T3 are turned on.

As shown in FIG. 2*a*, when the third transistor T3 is turned on, the high-level data signal Vdata is transmitted to the second node N2. Since the driving transistor Td is in the on-state during period t1, the driving transistor Td is still in the on-state at this time, and the high-level data signal Vdata continues to be transmitted to the third node N3. When the second transistor T2 is turned on, the high-level data signal Vdata continues to be transmitted to the first node N1, and the first node N1 at the low level is charged. As the voltage of the first node N1 continues to rise, the gate-source voltage Vgs of the driving transistor Td gradually increases from the initial Vref-Vdata until Vgs=Vth, where Vth is the threshold voltage of the driving transistor Td. For the P-type driving transistor Td, the threshold voltage Vth is negative. At this time, the driving transistor Td is no longer turned on, and at the same time, the charging of the first node N1 is stopped. At this time, the voltage at the first node N1 (i.e., the gate of Td) is Vg=Vgs+Vs=Vdata+Vth. The data signal Vdata has been written into the first node N1. In some embodiments, Vdata may have the first level (i.e., the high level VH).

As shown in FIG. 5*a*, during the third period t3, the gate driving signal CON2, the first resetting signal CON3, and the second resetting signal CON4 with the first level (i.e., the high level VH) are provided, and the lighting control signal CON1 with the second level (i.e., the low level VL) is provided.

Thus, during the third period t3, under the control of the light emitting control signal CON1, the fourth transistor T4 and the fifth transistor T5 are turned on. Under the control of the gate driving signal CON2, the second transistor T2 and the third transistor T3 are turned off. Under the control of the first resetting signal CON3 and the second resetting signal CON4, the sixth transistor T6 and the seventh transistor T7 are turned off.

As shown in FIG. 2*a*, when the fourth transistor T4 is turned on, the first voltage signal VDD is transmitted to the second node N2, i.e., Vs (the source voltage of the driving transistor Td)=VDD. At this time, since the first transistor T1, the second transistor T2, and the sixth transistor T6, which are electrically coupled to the first node N1, are all turned off, the first node N1 is in a floating state, and its voltage remains Vdata+Vth, i.e., Vg (the gate voltage of the driving transistor Td)=Vdata+Vth, therefore, Vgs=Vdata+Vth-VDD, which is less than the threshold voltage Vth of the driving transistor Td, so that the driving transistor Td is turned on. When the fifth transistor T5 is turned on, the driving current Id generated by the driving transistor Td is applied to the anode of the light emitting element OLED and drives the light emitting element OLED to emit light. The driving current Id flowing through the light emitting element OLED can be expressed by the following formula:

$$Id=K\cdot(Vgs-Vth)^2$$

$$=K\cdot(V\text{data}+Vth-VDD-Vth)^2$$

$$=K\cdot(VDD-V\text{data})^2$$

wherein K is the current constant associated with the driving transistor Td, and is related to the process parameters and geometric dimensions of the driving transistor Td. It can be known from the above formula that the driving current Id used to drive the light emitting element OLED to emit light has nothing to do with the threshold voltage Vth of the driving transistor Td.

Therefore, according to the embodiments of the present disclosure, the threshold voltage of the driving transistor Td can also be compensated, so as to stabilize the current flowing through the light emitting element OLED and improve the display effect.

As further shown in FIGS. 2*a* and 2*b*, after the pixel driving circuit of the current row realizes the driving display of the light emitting element OLED, the light emitting brightness of the OLED may be held during the process of driving display of the light emitting element OLED by pixel drive circuits of other rows. That is to keep the current flowing through the OLED unchanged.

According to the embodiment of the present disclosure, in the above holding period, on the one hand, since the leakage current $I_{off2}$ of the second transistor T2 and the leakage current $I_{off6}$ of the sixth transistor T6 respectively flow from the first node N1, the voltage of the first node N1 may reduce. On the other hand, since the leakage current $I_{off1}$ of the first transistor T1 flows into the first node N1, the voltage of the first node N1 may increase. By adjusting the channel width-to-length ratios of the first transistor T1, the second transistor T2, and the sixth transistor T6, the voltage of the first node N1 can be basically held unchanged, thereby holding the current flowing through the OLED unchanged.

In addition, in response to the second resetting signal CON4 used as the compensation control signal, during the first period t1, the second period t2, and the third period t3, the second resetting signal CON4 with the first level is always provided, the corresponding timing diagram is shown in FIG. 5*b*.

When the second resetting signal CON4 with the first level is always provided, the first transistor T1 and the seventh transistor T7 are always in the off state, and thus, during the first period t1, the resetting reference signal Vref is transmitted only via the turned-on sixth transistor T6, and the first node N1 is reset. The seventh transistor T7 in the off state shunts the leakage current flowing through the OLED in the black screen display state, so as to better display the black screen. For other operations, reference may be made to the operations during the above first time period t1, second time period t2, and third time period t3, which will not be repeated here.

According to an embodiment of the present disclosure, a display panel is also provided, and FIG. 6 shows a block schematic of a display panel 60 according to an embodiment of the present disclosure. As shown in FIG. 6, the display panel 60 may comprise a plurality of scan lines SL and a plurality of data lines DL, and the plurality of data lines DL and the plurality of scan signal lines SL are arranged crosswise. The display panel 60 may also comprise a plurality of pixel units 61, which are arranged in the form of a matrix at the intersection of each scan line SL and each data line DL, and are electrically coupled to the scan line SL of the plurality of scan lines and data line DL of the plurality of data lines. Each pixel unit of the plurality of pixel units 61 comprises a light emitting element OLED and a pixel driving circuit according to an embodiment of the present disclosure, and the structure of the pixel driving circuit is, for example, according to the pixel driving circuit 10 shown in FIG. 1 or the pixel driving circuit 20 shown in FIGS. 2*a* and 2*b*.

In some embodiments, the data signal received by the pixel driving circuit is provided via the data line DL for the pixel unit 61, and the gate driving signal received by the pixel driving circuit is provided via the scan line SL for the pixel unit 61.

The display panel according to the embodiments of the present disclosure can compensate the threshold voltage of the driving transistor, and at the same time, can improve the holding ability of the gate voltage of the driving transistor, thereby stabilizing the current flowing through the light emitting element OLED, avoiding the flicker phenomenon of the screen during low-frame-rate display, and improving the display effect. When displaying a static picture, the power consumption of the display panel can be reduced by lowering the frame rate of display.

The above detailed description has explained numerous embodiments by using schematic diagrams, flowcharts, and/or examples. In the case where such schematic diagrams, flowcharts and/or examples contain one or more functions and/or operations, those skilled in the art should understand that each function and/or operation in such schematic diagrams, flowcharts or examples can be implemented individually and/or together through various structures, hardware, software, firmware or substantially any combination of them.

Although the present disclosure has been described with reference to a few typical embodiments, it should be understood that the terms used are illustrative and exemplary rather than restrictive. Since the present disclosure can be implemented in various forms without departing from the spirit or essence of the disclosure, it should be understood that the above-mentioned embodiments are not limited to any of the foregoing details, but should be interpreted broadly within the spirit and scope defined by the appended claims. Therefore, all changes and modifications falling within the scope of the claims or their equivalents shall be covered by the appended claims.

We claim:

1. A pixel driving circuit of driving a light emitting element to emit light, comprising:

a driving sub-circuit, configured to generate a current for making the light emitting element emit light;

a light emitting control sub-circuit, electrically coupled to the driving sub-circuit and a first terminal of the light emitting element, wherein the light emitting control sub-circuit is configured to receive a light emitting control signal, and provide the current for making the light emitting element emit light to the first terminal of the light emitting element under a control of the light emitting control signal;

a driving control sub-circuit, electrically coupled to the driving sub-circuit, wherein the driving control sub-circuit is configured to receive a data signal and a gate driving signal, and provide the data signal to the driving sub-circuit under a control of the gate driving signal;

a resetting sub-circuit, electrically coupled to the driving sub-circuit and the first terminal of the light emitting element, and electrically coupled to the driving sub-circuit at a first node, wherein the resetting sub-circuit is configured to receive a first resetting signal and a second resetting signal, and reset the first node and the first terminal of the light emitting element under a control of the first resetting signal and the second resetting signal; and a compensation sub-circuit, electrically coupled to the first node, wherein the compensation sub-circuit is configured to receive a compensation control signal, and compensate a voltage of the first node under a control of the compensation control signal;

wherein the compensation sub-circuit comprises a first transistor, a gate of the first transistor is electrically coupled to receive the compensation control signal, a first electrode of the first transistor is electrically coupled to receive a first voltage signal, and a second electrode of the first transistor is electrically coupled to the first node, wherein a channel width-to-length ratio of the first transistor is greater than or equal to 10/3.5.

2. The pixel driving circuit of claim 1, wherein the first transistor is a P-type transistor.

3. The pixel driving circuit of claim 1, wherein the compensation control signal has a first level, and the first transistor is in an off state under the control of the compensation control signal.

4. The pixel driving circuit of claim 1, wherein the driving sub-circuit comprises a driving transistor, a second transistor, and a storage capacitor, wherein a gate of the driving transistor is electrically coupled to the first node, a first electrode of the driving transistor and the light emitting control sub-circuit are electrically coupled at a second node, and a second electrode of the driving transistor and the light emitting control sub-circuit are electrically coupled at a third node;

a gate of the second transistor is electrically coupled to receive the gate driving signal, a first electrode of the second transistor is electrically coupled to the first node, and a second electrode of the second transistor is electrically coupled to the third node; and a first terminal of the storage capacitor is electrically coupled to receive the first voltage signal, and a second terminal is electrically coupled to the first node.

5. The pixel driving circuit of claim 4, wherein the driving transistor is a P-type transistor.

6. The pixel driving circuit of claim 4, wherein a channel width-to-length ratio of the second transistor is less than or equal to 2/3.5.

7. The pixel driving circuit of claim 1, wherein the driving control sub-circuit comprises a third transistor, a gate of the third transistor is electrically coupled to receive the gate driving signal, a first electrode of the third transistor is electrically coupled to receive the data signal, and a second electrode of the third transistor and the light emitting control sub-circuit are electrically coupled at the second node.

8. The pixel driving circuit of claim 1, wherein the light emitting control sub-circuit comprises a fourth transistor and a fifth transistor, wherein a gate of the fourth transistor is electrically coupled to receive the light emitting control signal, a first electrode of the fourth transistor is electrically coupled to receive a first voltage signal, and a second electrode of the fourth transistor and a light emitting control sub-circuit are electrically coupled at the second node;

a gate of the fifth transistor is electrically coupled to receive the light emitting control signal, a first electrode of the fifth transistor and the light emitting control sub-circuit are electrically coupled to a third node, and a second electrode of the fifth transistor is electrically coupled to the first terminal of the light emitting element.

9. The pixel driving circuit of claim 1, wherein the resetting sub-circuit comprises a sixth transistor and a seventh transistor, wherein a gate of the sixth transistor is electrically coupled to receive the first resetting signal, a first electrode of the sixth transistor is electrically coupled to the first node, and a second electrode of the sixth transistor is electrically coupled to receive a resetting reference signal;

a gate of the seventh transistor is electrically coupled to receive the second resetting signal, a first electrode of the seventh transistor is electrically coupled to receive the resetting reference signal, and a second electrode of the seventh transistor is electrically coupled to the first terminal of the light emitting element.

10. The pixel driving circuit of claim 9, wherein a channel width-to-length ratio of the sixth transistor is less than or equal to 2/3.5.

11. The pixel driving circuit of claim 1, wherein the resetting sub-circuit comprises a sixth transistor and a seventh transistor, wherein a gate of the sixth transistor is electrically coupled to receive the first resetting signal, a first electrode of the sixth transistor is electrically coupled to the first node, and a second electrode of the sixth transistor is electrically coupled to receive a resetting reference signal;

a gate of the seventh transistor is electrically coupled to receive the second resetting signal, a first electrode of the seventh transistor is electrically coupled to receive the resetting reference signal, and a second electrode of the seventh transistor is electrically coupled to the first terminal of the light emitting element;

wherein the second resetting signal is used as the compensation control signal.

12. A display panel, comprising:

a plurality of scan lines;

a plurality of data lines, arranged to cross the plurality of scan lines; and a plurality of pixel units, arranged in a form of a matrix at an intersection of each data line and each scan line, wherein the plurality of pixel units are electrically coupled to a data line of the plurality of data lines and a scan line of the plurality of scan lines, wherein each pixel unit comprises a light emitting element and the pixel driving circuit of claim 1, wherein a data signal received by the pixel driving circuit is provided via the data line for the pixel unit, and a gate driving signal received by the pixel driving circuit is provided via the scan line for the pixel unit.

13. A method of driving the pixel driving circuit to claim 1, comprising:

providing a light emitting control signal and a gate driving signal with a first level, and providing a first resetting signal and a second resetting signal with a second level, during a first period;

providing a light emitting control signal, a first resetting signal, and a second resetting signal with a first level, and providing a gate driving signal with a second level, during a second period; and providing a first resetting signal, a second resetting signal, and a gate driving signal with a first level, and providing a light emitting control signal with a second level, during a third period.

14. The method of claim 13, further comprising providing a compensation control signal with the first level during the first period, the second period and the third period.

15. The method of claim 14, further comprising, in response to the second resetting signal being used as the compensation control signal, providing a second resetting signal with a first level, during the first period, the second period and the third period.

* * * * *